United States Patent [19]

Nishijima et al.

[11] Patent Number: 4,770,552

[45] Date of Patent: Sep. 13, 1988

[54] PRINTING APPARATUS FOR ACCENTUATING THE OUTLINE PORTION OF A PRINTED CHARACTER

[75] Inventors: Takeo Nishijima, Ito; Kazuhide Takahama, Shizuoka; Hiroshi Sugiyama, Shizuoka, all of Japan

[73] Assignee: Tokyo Electric Co., Ltd., Tokyo, Japan

[21] Appl. No.: 27,826

[22] Filed: Mar. 19, 1987

[30] Foreign Application Priority Data

Mar. 27, 1986 [JP] Japan ..... 61-69125

[51] Int. Cl.[4] ..... B41J 3/12

[52] U.S. Cl. ..... 400/121; 340/730; 400/120

[58] Field of Search ..... 340/730; 346/76 PH, 346/140 PD; 400/120, 121, 119, 157.3, 166

[56] References Cited

U.S. PATENT DOCUMENTS

| | | | |
|---|---|---|---|
| 3,744,611 | 7/1973 | Montanari | 400/120 |
| 3,918,039 | 11/1975 | Clark | 340/730 |
| 4,195,937 | 4/1980 | Baran | 400/120 |
| 4,590,484 | 5/1986 | Matsushita | 346/76 PH |

*Primary Examiner*—Paul T. Sewell

*Attorney, Agent, or Firm*—Frishauf, Holtz Goodman & Woodward

[57] ABSTRACT

A printing device comprising a character generator storing items of character data, each constituted by a plurality of printing dot data, a first memory for storing the character data read out from the character generator, a printer, and a control unit for driving the printer such that the printer prints the characters represented by the character data, accentuating the outline portions of each character. The printing device further comprises a second memory. The control unit derives, from the character data stored in the first memory, outline-image data representing the outline portions of the characters represented by the character data, and writes the outline-image data into the second memory. It drives the printer in accordance with the character data stored in the first memory and also with the outline-image data stored in the second memory, thereby printing, with a first printing energy, those dots specified by both the character data and the outline-image data, and printing, with a second printing energy, less than the first printing energy, those dots specified by the outline-image data.

10 Claims, 6 Drawing Sheets

PRINTING APPARATUS FOR ACCENTUATING THE OUTLINE PORTION OF A PRINTED CHARACTER

BACKGROUND OF THE INVENTION

The present invention relates to a printing device which can print characters, and which can accentuate at least part of the outline portion of the characters for reasons of aesthetics and clarity.

A dot-matrix printer prints characters in accordance with the character data stored in a specified portion of a memory, generally known as the "character generator." The character data represents the dot-patterns of the characters to be printed. To print a character, its dot-pattern is read out from the character generator. Those dot-elements of a printing head which correspond to the dot-pattern are each supplied with an equal amount of energy, thereby driving them and printing the character. To print a character in a dot-pattern different from that stored in the character generator, the dot-pattern most similar to that of the character in question is read out from the character generator, is altered in accordance with a computer program, and the data representing this new dot-pattern is used for subsequent printing of the character.

This method of printing characters is employed not only in printers which utilize an ink layer having a specific electrical resistance, but also in wire-dot printers and thermal-transfer printers. Generally, the dot-patterns representing alphabetic and Chinese characters are constructed such that any vertical element of the characters (hereinafter called "character element") consists of three columns of dots, and any horizontal character element consists of one row of dots. Hence, when printed, the horizontal character element appears less dark than the vertical character element. Further, the printed vertical character element having a width of more than two dots appears dark at the center but somewhat blurred at both outline portions. Consequently, the character, as a whole, appears blurred, not having sharply-defined outlines.

However, if greater energy is applied to those dot elements of the printing head which print dots forming the outlines of the character, than to the other dot elements which print the dots forming other portions of the character the printer can achieve high-quality printing, that is, it can print a character having sharply-defined outlines. In order to accomplish such high-quality printing, some conventional printers have an auxiliary character generator, i.e., another portion of the memory, in addition to the character generator (hereinafter called the "main character generator"). The auxiliary character generator is a memory for storing data items which represent the dot-patterns of the outline portions of frequently used characters. To print any desired character, the two corresponding dot-patterns are read out from the main and auxiliary character generators. An equal amount of energy is applied to each of those dot-elements of the printing head which correspond to the dot-pattern read out from the main character generator, and simultaneously, a predetermined energy is applied to those dot-elements which correspond to the dot pattern read out from the auxiliary character generator. Thus, greater energy is applied to the dot-elements corresponding to the outline portions of the character, than to those corresponding to the other portions thereof, with the result that the outline portions of the character are printed darker than the other portions thereof.

The higher the resolution of the character to be printed by the printer, the greater the amount of memory space the character generator occupies. The greater the number of characters used, the greater the amount of memory space required to store dot-patterns. Under these circumstances, it would not be advisable to use an auxiliary character generator in addition to a main character generator.

SUMMARY OF THE INVENTION

It is accordingly the object of this invention to provide a printing device which is provided with only one character generator and yet can print characters having sharply-defined outlines.

According to the present invention, a printing device is provided, comprising character-generating means storing items of character data, each constituted by a plurality of printing dot data; first memory means for storing the items of character data read out from the character-generating means; second memory means; printing means; and control means for deriving, from the printing dot data of the character data stored in the first memory means, outline-image data representing the outline portions of the characters represented by the character data, for writing the outline-image data into the second memory, and driving the printing means in accordance with the character data stored in the first memory means and also with the outline-image data stored in the second memory means, thereby printing, with a first printing energy, those dots specified by both the character data and the outline-image data, and printing, with a second printing energy, less than the first printing energy, those dots specified only by the character data.

In the printing device according to the invention, the character data read out from the character generator can be processed by means of software, to thereby provide dot-pattern data representing the outline portions of characters. The device, therefore, does not require an auxiliary character generator for storing the dot-pattern data representing the outline portions of the characters. Hence, in the printing device of the present invention that memory portion to be used as the character generator is relatively small.

DETAILED DESCRIPTION OF THE PREFERRED EMBODIMENTS

Figure 1:
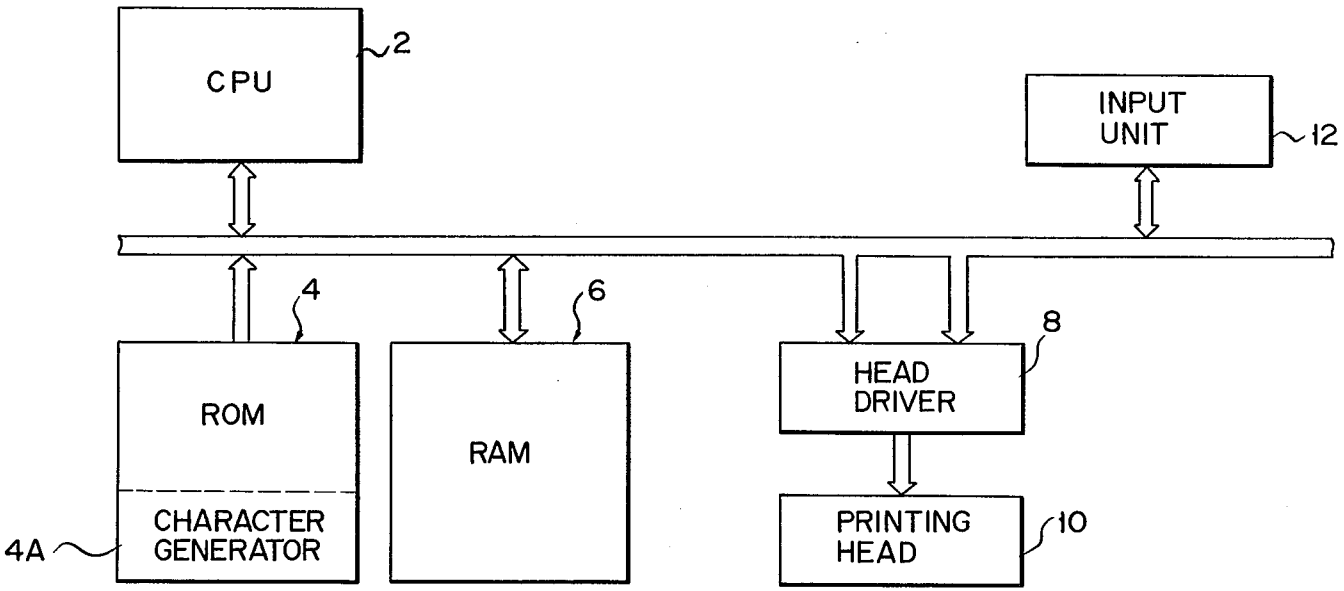
FIG. 1 is a block diagram schematically illustrating a printing device according to the present invention.
Figure 2:
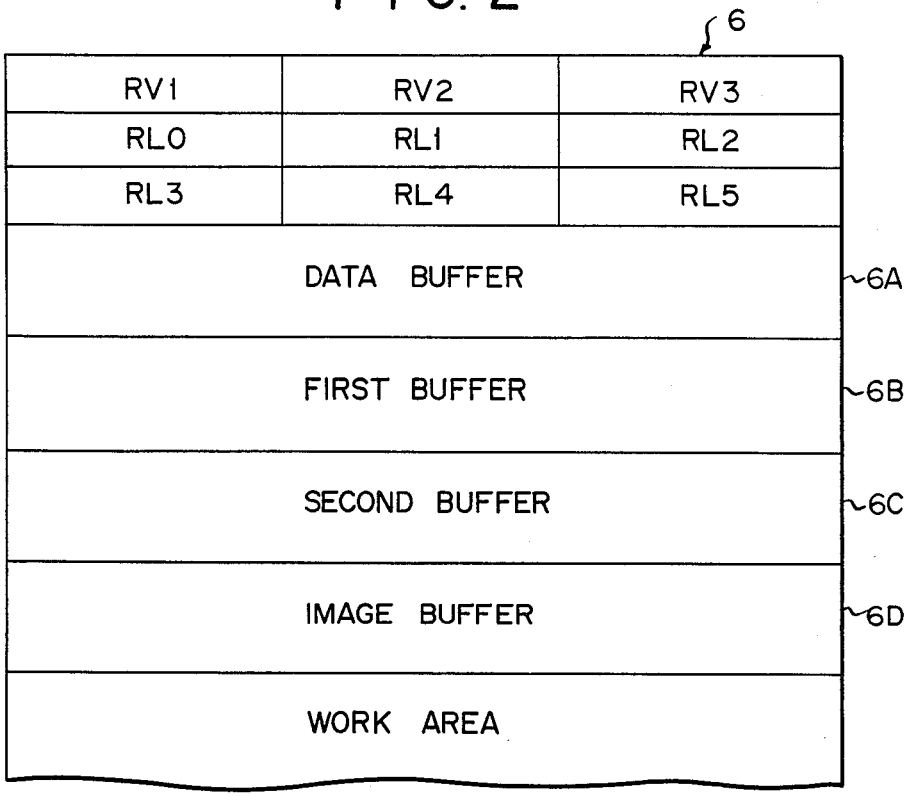
FIG. 2 shows the memory map of the RAM used in the device shown in FIG. 1.
Figure 3:
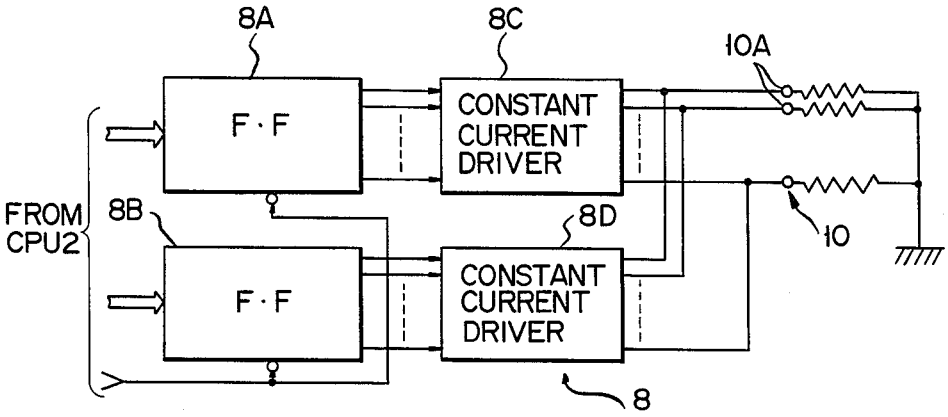
FIG. 3 is a block diagram showing the printing head and head driver, both used in the device of FIG. 1.

FIG. 1 is a block diagram of a printing device according to the present invention. As is shown in this figure, the device comprises CPU 2, ROM 4, RAM 6, head driver 8, printing head 10, and input unit 12. ROM 4 stores a program for controlling the device; it includes character generator 4A storing pieces of character data representing the dot-patterns of characters. RAM 6 is used to store input data and also the results of the calculation CPU 2 has performed; it includes buffer registers RL0 to RL5, buffer registers RV1 to RV3, data buffer 6A, first and second buffers 6B and 6C, and outline-image buffer 6D. Head driver 8 is provided for driving a printing head 10 in accordance with the print data supplied from CPU 2. Input unit 12 supplies print instructions to CPU 2. As is shown in FIG. 3, head driver 8 includes two flip-flop circuits 8A and 8B, and two constant current drivers 8C and 8D. CPU 2 supplies character data, dot-column by dot-column, to flip-flop circuit 8A, and supplies outline image data, also dot-column by dot-column to flip-flop circuit 8B. Constant current driver 8C supplies a constant current to an output line or output lines in response to output signals of flip-flop circuit 8A. Similarly, constant current driver 8C supplies a constant current to an output line or output lines in response to output signals of flip-flop circuit 8B. Printing head 10 is of the type utilizing an ink layer having a specific electric resistance, and has a plurality of electrode elements 10A to which the constant currents are selectively supplied from drivers 8C and 8D. Electrode elements 10A are held in contact with an ink ribbon (not shown) supported or held on an aluminum film (not shown). When a current flows from any selected element 10A to the aluminum film through that portion of the ink ribbon which contacts element 10A, the ink layer on this portion of the ribbon, which has an electric resistivity, generates heat and melts itself, and the ink is transferred to printing paper.

The printing device can operate in two modes, i.e., ordinary printing mode and outline-accentuating printing mode. In the ordinary printing mode, CPU 2 reads character data from character generator 4A in response to the printing instruction supplied from input unit 12; this data represents the dot-patterns of characters of one printing line. The data is transferred to data buffer 6A of RAM 6. In accordance with the one-line character data stored in data buffer 6A, CPU 2 drives head driver 8, which in turn drives printing head 10. The characters of the one printing line are thereby printed on printing paper, not accentuating with the outline portions of each character.

When the printing device is set into the outline-accentuating printing mode from a printing instruction input through input unit 12 or supplied from other means, CPU 2 reads out one-line character data from character generator 4A and writes it into data buffer 6A. Then, the data representing the vertical outline portions (hereinafter called "vertical-outline data"), and the data representing the horizontal outline portions (hereinafter called "horizontal-outline data") are obtained by specific calculations (later described). The vertical-outline data is stored into first buffer 6B. The horizontal-outline data is stored into second buffer 6C. The vertical-outline data and the horizontal-outline data are ORed, thereby providing outline-image data. The outline-image data is stored into outline-image buffer 6D. CPU 2 drives head driver 8 in accordance with the one-line character data stored in data buffer 6A and the outline-image data stored in buffer 6D, in such a way as will be later described. Head driver 8 drives printing head 10, and head 10 prints the one line of characters, accentuating the outline portions of each character.

The printing in the outline-accentuating printing mode will be explained in greater detail, taking the printing of letter "D" for an example.

Figure 4A:
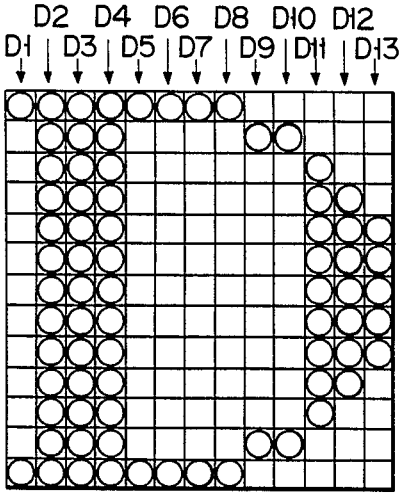
FIG. 4A shows a dot-pattern of letter "D"
Figure 5A:
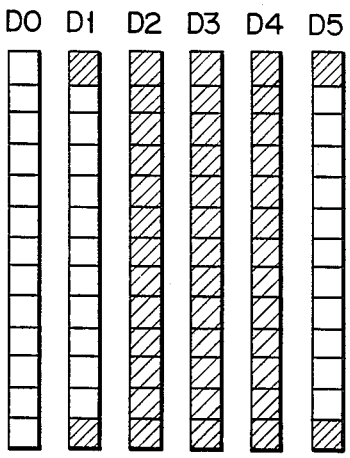
FIGS. 5A to 5C are diagrams showing respective parts of the dot-patterns shown in FIGS. 4A to 4C.

Each of the pieces of character data stored in character generator 4*a* represents a dot-pattern, i.e., some dots of a 13×13 dot-matrix pattern, defining one character. FIG. 4A shows the dot-pattern of letter "D." In this figure, the circles represent the dots to be printed to form letter "D." The piece of character data for letter "D" consists of "1" bits representing the dots, and "0" bits denoting blank spaces. FIG. 5A is a magnified view of a portion of the dot-pattern shown in FIG. 4A. In FIG. 5A, the shaded squares represent the dots forming a part of letter "D." As is evident from FIG. 5A, any horizontal character element is formed of one dot-row and is thus thin, and any vertical character element is formed of three dot-columns and is therefore thick.

Figure 4B:
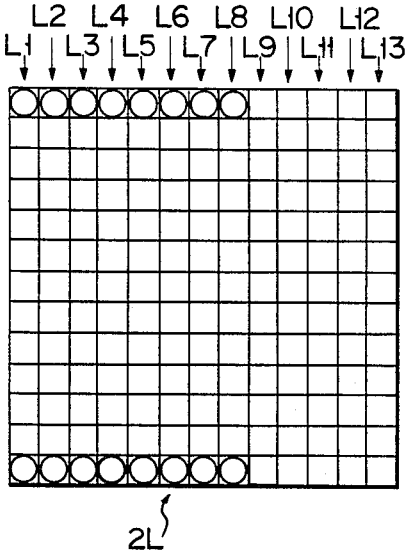
FIG. 4B represents a dot-pattern of the horizontal outline elements of letter "D"
Figure 4C:
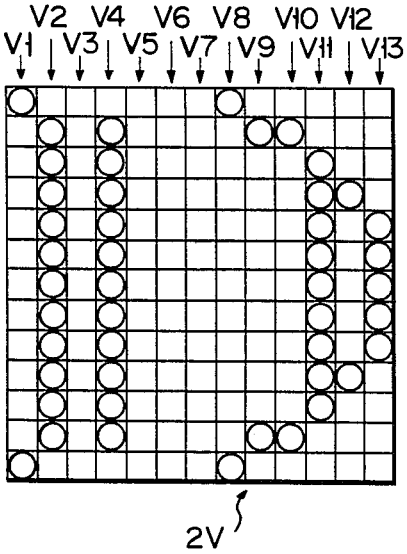
FIG. 4C shows a dot-pattern of the vertical outline elements of letter "D"

The outline-image data, which is indispensable to print letter "D" with accentuated outline portions, is provided in the following manner. First, the dot-pattern of "D" is read out from character generator 4A and processed by using software (more precisely, a computer program for processing character dot-patterns), thereby forming the outline dot-pattern shown in FIG. 4D. Extremely complex calculations would be required to form the outline dot-pattern at a time. Hence, the horizontal outline dot-pattern shown in FIG. 4B is first formed, and the vertical outline dot-pattern shown in FIG. 4B is then formed. The dot-patterns of FIGS. 4B and 4C are stored in first and second buffers 6B and 6C, respectively. These patterns are ORed, thereby providing outline-image data representing the outline dot-pattern of "D", shown in FIG. 4D. The outline-image data is stored into outline-image buffer 6D.

Figure 6:
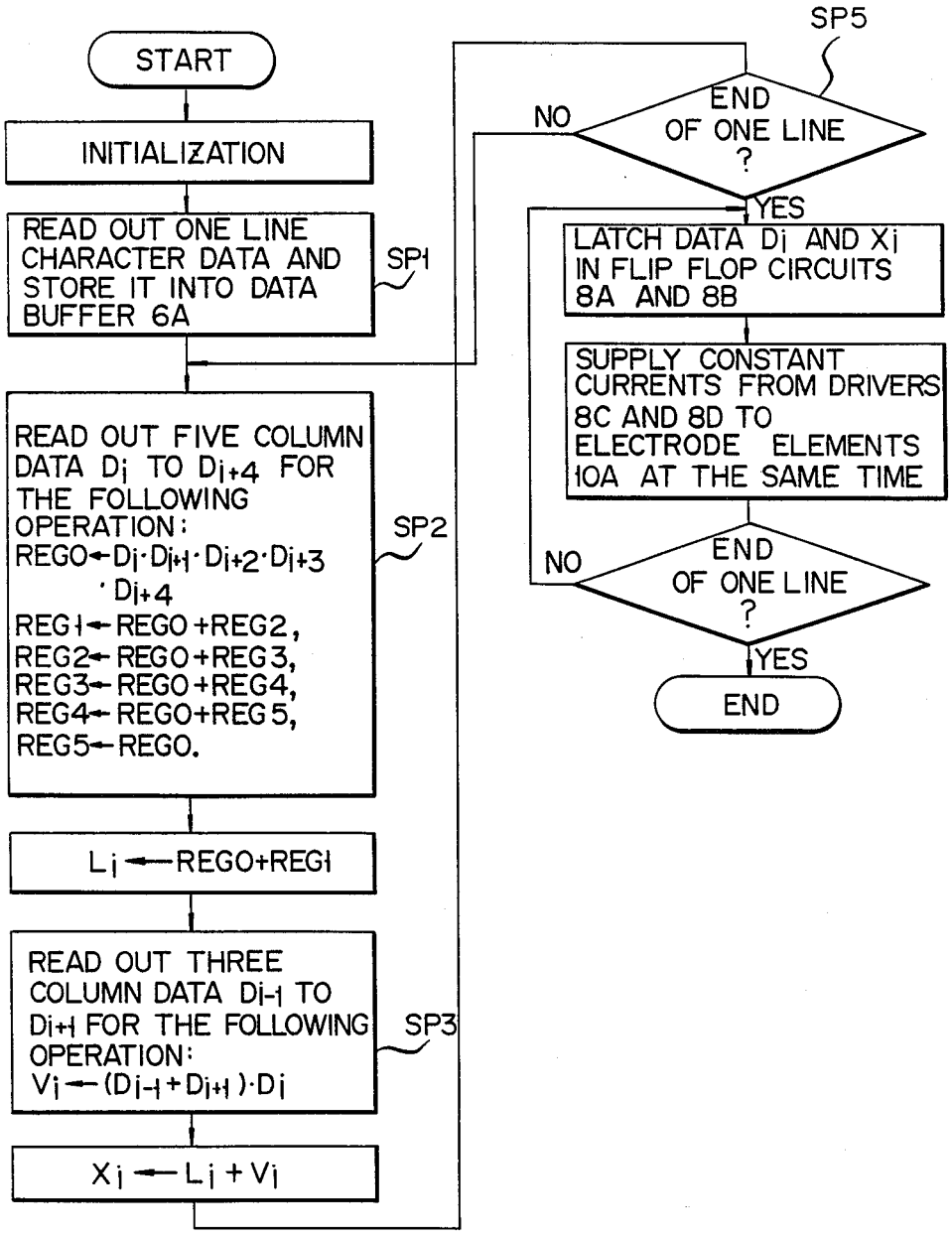
FIG. 6 is a flow chart explaining the operation of the printing device shown in FIGS. 1 to 3.

With reference to the flow chart of FIG. 6, it will now be described in detail how the outline-image data is obtained.

In step SP1, one-line character data representing the dot-patterns of characters, which are similar to the dot-pattern shown in FIG. 4A, is read out from character generator 4A and stored into data buffer 6A. In step SP2, the horizontal outline dot-pattern of the first character is calculated, dot-column by dot-column. In this embodiment, a row of five or more consecutive dots is regarded as being an effective horizontal outline segment. In order to distinguish such a row from rows of four dots or less, the following calculation is performed. First, buffer registers REG0 to REG5 included in RAM 6 are cleared. Then, the first to fifth pieces of dot-column data, D1 to D5 (FIG. 4A), all stored in data buffer 6A and each consisting of 13 bits, are ANDed, thus providing a logical product [D1·D2·D3·D4·D5]. This logical product is stored into buffer register REG0. Hence, when at least one of the five bits representing the consecutive five dots of any row in the 13×13 dot-matrix is "0," the logical product stored in a corresponding bit position of register REG0 is "0." In this case, these five bits are not regarded as representing an effective horizontal outline segment. In the case of letter "D" whose dot-pattern is shown in FIG. 4A, the first five dots of the first row are represented by "1" bits. In other words, bits $D1_1$, $D2_1$, $D3_1$, $D4_1$ and $D5_1$ are "1" bits. Hence, the logical product $[D1_1 \cdot D2_1 \cdot D3_1 \cdot D4_1 \cdot D5_1]$ is "1." This "1" bit is stored at first bit location REG01 of buffer register REG0.

The bits obtained by the logical operation are then stored at first bit locations REG11, REG21, REG31, REG41 and REG51 of buffer registers REG1 to REG5, as is shown below.

REG11←REG01+REG21=1
REG21←REG01+REG31=1
REG31←REG01+REG41=1
REG41←REG01+REG51=1
REG51←REG01=1

The bits to be stored at the second to thirteenth bit locations of each of buffer registers REG1 to REG5 are calculated from the five pieces of dot-column data D1, D2, D3, D4 and D5 in the same manner as described above. These bits are stored in buffer registers REG1 to REG5. As a result, 13-bit column data is stored in each of buffer registers REG0 to REG5.

Figure 5B:
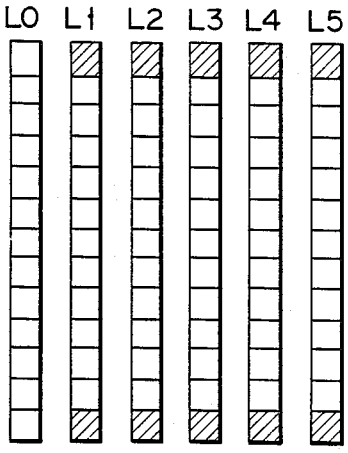
Figure 5C:
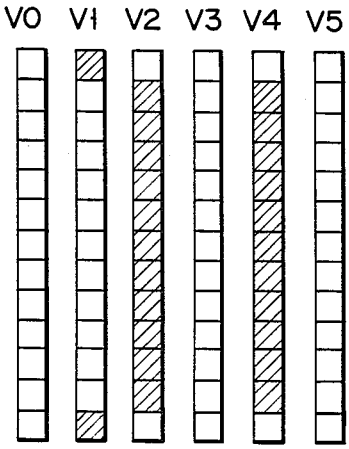

The 13-bit column data stored in register REG0 and the 13-bit column data stored in register REG1 are ORed, thereby providing 13-bit logical sum (REG0+REG1). This logical sum is stored as horizontal-outline data L1 (FIGS. 4B and 5B) for the first column of the 13×13 dot-matrix pattern. That is, data L1 is stored at the first column location of first buffer 6B.

Figure 4D:
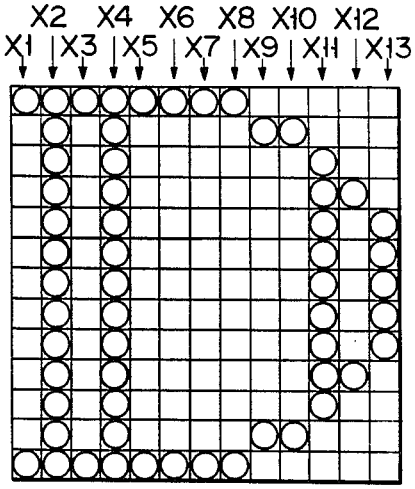
FIG. 4D shows a dot-pattern of all outline elements of letter "D"

Thereafter, in step SP3, vertical-outline data V1 is provided by the specific method which will be described later. Horizontal-outline data L1 and vertical-outline data V1 are ORed in step SP4, thus providing outline data X1 for the first column of the 13×13 dot-matrix pattern. Outline data X1 is shown in FIG. 4D. Then, horizontal-outline data L2 for the second column of the dot-matrix pattern is provided in the same way as horizontal-outline data L1, while the data obtained in the preceding data-processing cycle is being held in buffer register REG0 to REG5. More specifically, the second to sixth pieces of dot-column data D2 to D6 are read out from data buffer 6A, and are ANDed. The bits obtained by this logical operation are stored into registers REG0 to REG5, as is shown below:

$REG01 \leftarrow D2_1 \cdot D3_1 \cdot D4_1 \cdot D5_1 \cdot D6_1 = 1$
REG11←REG01+REG21=1
REG21←REG01+REG31=1
REG31←REG01+REG41=1
REG41←REG01+REG51=1
REG51←REG01=1

The bits to be stored at the other bit locations of each of buffer registers REG0 to REG5 are also calculated from the pieces of dot-column data D2 to D6 in the same manner as described above. As a result, 13-bit column data is stored in each of registers REG0 to REG5. Then, the 13-bit column data stored in register REG0 and the 13-bit column data stored in register REG1 are ORed, thus providing logical sum (REG0+REG1). This logical sum is stored as horizontal-outline data L2 (FIGS. 4B and 5B) for the second column of the 13×13 dot-matrix pattern, into the second column location of first buffer 6B.

The sequence of the logical operations and data-storing operations, described above, is repeated in step SP5 until the outline-image data for all dot-patterns of characters stored in data buffer 6A is obtained. Horizontal-outline data L8 for the eighth column of the 13×13 dot-matrix pattern, for example, is obtained in the following manner. First, the eighth to twelfth pieces of dot-column data D8 to D12 are read out from data buffer 6A. The five pieces of data D81 to D121 representing eighth to twelfth dot of the first row of the dot-matrix pattern (FIG. 4A) are "1", "0", "0", "0" and "0". These five bits are ANDed, thus providing the logical product $[D8_1 \cdot D9_1 \cdot D10_1 \cdot D11_1 \cdot D12_1]$. This logical product is "0". Hence, "0" bit is stored at the first bit location REG01 of buffer register REG0. Namely:

$REG01 \leftarrow D8_1 \cdot D9_1 \cdot D10_1 \cdot D11_1 \cdot D12_1 = 0$

In the preceding data-processing cycle, five bits "1", "0", "0", "0" and "0" have been stored at the first bit locations REG11 to REG51 of registers REG1 to REG5, as is shown below:

REG11←REG01+REG21=1

REG21←REG01+REG31=0

REG31←REG01+REG41=0

REG41←REG01+REG51=0

REG51←REG01=0

The first bit of horizontal-outline data L8 is therefore "1", that is, (REG01+REG11)=1. The first bit of the next horizontal-outline data, L9, is "0", that is, (REG01+REG11)=0, as can be understood from FIG. 4B.

When all pieces of dot-column data D1 to D13 for the dot-pattern of letter "D" shown in FIG. 4A are processed, the horizontal-outline image data shown in FIG. 4B is obtained.

The vertical-outline image data is provided in step SP3 by performing the following calculation:

$$[(\overline{\text{previous printing data}}+(\overline{\text{next printing data}})]\cdot(\text{present printing data})$$

More specifically, in the case of vertical-outline data V1 for the first column of the 13×13 dot-matrix pattern of letter "D" shown in FIG. 4A, the previous printing data is D0, the present printing data is D1, and the next printing data is D2, as is evident from FIGS. 4A and 5A. One-bit data V11, or the first bit of vertical-outline data V1, is "1" [=(1+0)·1]. One-bit vertical-outline data V11, thus obtained, is stored at the first bit location of the first column of second buffer 6C. The second to thirteenth bits of vertical-outline data V1 are derived from pieces of data D0, D1 and D2 in the same manner as described above. These bits are stored at the second to thirteenth bit locations of the first column of second buffer 6C.

In the second cycle of step SP3, vertical-outline data V2 is calculated. In this case, the previous printing data is D1, the present printing data is D2, and the next printing data is D3, as is understood from FIGS. 4A and 5A. One-bit data $D2_1$, or the first bit of vertical-outline data V2, is "0" [=(0+0)·1]. One-bit vertical-outline data $V_{21}$, thus produced, is stored at the first bit location of the second column of second buffer 6A. The second to thirteenth bits of vertical-outline data V2 for the second column of the dot-matrix pattern of FIG. 4A are calculated from pieces of data D1, D2 and D3 in the same manner as described before. These bits are stored at the second to thirteenth bit locations of the second column of second buffer 6A.

Likewise, in the remaining eleven cycles of step SP3, vertical-outline data V3, etc. are calculated, and are stored at the third to thirteenth columns of second buffer 6A. As a result, the vertical-outline image data shown in FIG. 4C is obtained.

As has been described above, each horizontal-outline data Li produced in step SP2, and the corresponding vertical-outline data Vi provided in step SP3 are ORed in step SP4, thereby providing outline data Xi. This outline data Xi is stored at the ith column of outline-image buffer 6D. Hence, the outline-image data representing the outline dot-pattern shown in FIG. 4D is obtained from the horizontal-outline image data showing the dot-pattern of FIG. 4B and the vertical-outline image data showing the dot-pattern of FIG. 4C.

Thereafter, in step SP5, it is determined whether or not the outline-image data for all dot-patterns (i.e., the dot-patterns of the characters forming one printing line) stored in data buffer 6A has been provided. For example, as is practiced in the art, the column number i is incremented by one every time one piece of outline data Xi is produced, and it is checked whether or not the number i has reached the number of all columns of dots forming one printing line of characters stored in data buffer 6A.

When YES in step SP5, CPU 2 causes flip-flop circuit 8A to latch data D1 stored at the first column of data buffer 6A, and also causes flip-flop circuit 8B to latch outline data X1 stored at the first column of outline-image buffer 6D. Flip-flop circuits 8A and 8B, therefore, supply output signals, which correspond to data D1 and data X1, to constant current drivers 8C and 8D, respectively. That is, flip-flop 8A supplies 13 bit-signals to constant current driver 8C, and driver 8C supplies a constant current for a predetermined period to the selected ones of electrode elements 10A, which are coupled to those of the output lines of driver 8C which correspond to the input terminals receiving "1" bits from flip-flop circuit 8A. Similarly, flip-flop 8B causes current driver 8D to supply a constant current for the same period to the selected ones of electrode elements 10A.

Figure 7:
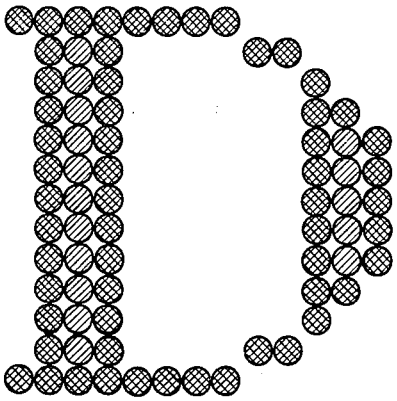
FIG. 7 shows an example of letter "D" printed by the device illustrated in FIGS. 1 to 3.

For example, flip-flop circuits 8A and 8B, and constant current drivers 8C and 8D operate in the following manner, in order to print the dots of the third column of the 13×13 dot-matrix pattern shown in FIG. 4A. As is evident from FIGS. 4A and 4D, thirteen "1" bits are input to flip-flop circuit 8A, and 13-bit data, wherein only the first and thirteenth bits are "1", is input to flip-flop circuit 8B. Flip-flop circuit 8A supplies thirteen signals at logic "1" to constant current driver 8C, whereas flip-flop circuit 8B supplies two signals at logic "1" level to the first and thirteenth input terminals of constant current driver 8D and eleven signals at logic "0" to the second to twelfth input terminals of driver 8D. Driver 8C supplies the constant current to all electrode elements 10A of printing head 10 for a preset period. On the other hand, driver 8D supplies the constant current to only the first and thirteenth electrode elements 10A for a preset period. As a result, a greater current is supplied to the first and thirteenth elements 10A than to the other electrode elements 10A. Those two portions of the ink ribbon which contact the first and thirteenth elements 10A receive this great current, while the other portions contacting the second to twelfth elements 10A receive a small current. Hence, those portions of the ink layer which are coated on the two portions of the ink ribbon generate more heat than the other portions of the ink layer. Therefore, the first and second electrode elements 10A transfer more ink to the printing paper than the second to twelfth electrode elements 10A. Consequently, the first and thirteenth dots printed on the paper are darker than the second to twelfth dots printed on the paper, as is illustrated in FIG. 7.

In the embodiment described above, the outline-image data is produced from the character data read out from data buffer 6A. It is therefore unnecessary to provide a character generator in ROM 4, in order to store the outline-image data. Whatever dot-patterns the character data read out from data buffer 6A represents, outline-image data representing the outline portions of any character, which need to be printed darker than other portions of the character, can be readily obtained.

The present invention has been explained with reference to an embodiment. Nonetheless, this does not mean that the invention is limited to the embodiment. For example, each horizontal character element can consist of two or more rows of dots, instead of one row of dots as in the embodiment described above. For example, in a case where each vertical character element has a width of six dots and each horizontal character element has a width of three dots, three dot-lines of a horizontal character element having a length of five or more dots are all printed with a larger printing energy.

Figure 8:
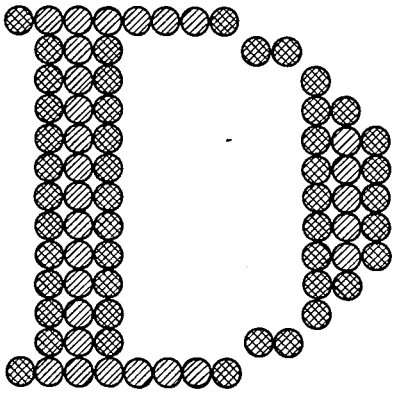
FIGS. 8 and 9 respectively show examples of letter "D" printed by modifications of the device illustrated in FIGS. 1 to 3.
Figure 9:
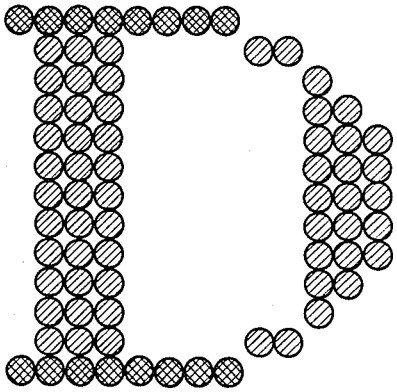

Further, step SP2 can be omitted, thereby to produce only vertical-outline data Vi, and thus printing characters within only the vertical-outline portions accentuated. Alternatively, step SP3 can be omitted, thereby to produce only horizontal-outline data Li, and thus to print characters with only their horizontal-outline portions accentuated. FIG. 8 shows letter "D" printed with only its vertical-outline portions accentuated. FIG. 9 shows letter "D" printed with only its horizontal-outline portions accentuated.

Moreover, first and second buffer registers 6B and 6C can be replaced by two one-column buffer registers. If this is the case, the horizontal-outline data and vertical-outline data, which are obtained in each cycle of producing the outline-image data for one column of the dot-matrix pattern, are stored in these one-column buffer registers.

Still further, the shortest horizontal character element that can be regarded as a horizontal outline can be a row of a different number of dots, instead of a row of five dots as in the embodiment described above.

Furthermore, a thermal printing head, an ink-dot printing head, or the like can be used in place of printing head 10 which utilizes the electric resistance of the ink layer.

What is claimed is:

1. A printing apparatus comprising:

character-generating means for storing items of character data, each constituted by a plurality of printing dot data;

first memory means for storing the items of character data read out from said character-generating means;

second memory means;

printing means; and control means for (a) driving, from the printing dot data of the character data stored in said first memory means, outline-image data representing outline portions of characters represented, respectively, by the character data, (b) writing the outline-image data into said second memory, and (c) driving said printing means in accordance with the character data stored in said first memory means and also with the outline-image data stored in said second memory means, thereby printing, with a first printing energy, dots specified by both the character data and the outline-image data, and printing, with a second printing energy less than the first printing energy, dots specified only by the character data;

wherein said second memory means has first, second and third memory areas, and said control means (d) derives, from a predetermined number of printing dot data of a particular character read out from said first memory means, horizontal-outline data representing horizontal-outline portions of the particular character, (e) writes the horizontal-outline data into said first memory area of said second memory means, (f) derives, from a predetermined number of printing dot data of said particular character read out from said first memory means, vertical-outline data representing vertical-outline portions of the particular character, (g) writes the vertical-outline data into said memory area of said second memory means, and (h) writes outline-image data which is a logical sum of the horizontal-outline data and the vertical outline data into said third memory area of said second memory means.

2. A printing device according to claim 1, wherein said printing means is a printer of the type which utilizes an ink layer having a specific electrical resistance.

3. A printing device according to claim 1, wherein said printing means has N electrode elements, a first latch circuit for latching said character data read out from said first memory means, a second latch circuit for latching said outline-image data read out from said second memory means, a first constant-current driving circuit for supplying a constant driving current to selected ones of said N electrode elements in accordance with an output signal of said first latch circuit, and a second constant-current driving circuit for supplying a driving current to the selected ones of said N electrode elements in accordance with an output signal of said second latch circuit, simultaneously with the driving current supplied by said first constant-current driving circuit.

4. A printing apparatus comprising:

character-generating means storing items of character data, each constituted by a plurality of printing dot data;

first memory means for storing the items of character data read out from said character-generating means;

second memory means;

printing means; and control means for (a) deriving, from the printing dot data of the character data stored in said first memory means, outline-image data representing outline portions of characters represented, respectively, by the character data, (b) writing the outline-image data into said second memory, and (c) driving said printing means in accordance with the character data stored in said first first memory means and also with the outline-image data stored in said second memory means, thereby printing, with a first printing energy, dots specified by both the character data and the outline-image data, and printing, with a second printing energy less than the first printing energy, dots specified only by the character data;

wherein said first memory means includes a memory area having M columns×N rows, said second memory means has a first memory, a second memory, and a third memory having, respectively, a memory area of M columns×N rows, and said control means (d) derives, from a first column data group of m1 (<M) columns read out from said first memory means in each outline data-forming cycle, one-column horizontal-outline data representing part of a horizontal-outline portion of a character pattern represented by the first column data group, (e) writes the one-column horizontal-outline data into said first memory of said second memory means, (f) derives from a second column data group of m2 (<M) columns read out from said first memory means, one-column vertical-outline data representing part of a vertical-outline portion of a character pattern represented by the second column data group, (g) writes the one-column vertical-outline data into said second memory of said second memory means, and (h) writes one-column outline data, which is a logical sum of the one-column horizontal-outline data and the one-column vertical-outline data, into a column location of said third memory area which corresponds to said first column data group and said second column data group, both read out from said first memory means, said one-column horizontal-outline data and said one-column vertical-outline data being produced in the same cycle of producing outline data.

5. A printing device according to claim 4, wherein said printing means has N electrode elements, a first latch circuit for latching said character data read out from said first memory means, a second latch circuit for latching said outline-image data read out from said second memory means, a first constant-current driving circuit for supplying a constant driving current to selected ones of said N electrode elements, in accordance with an output signal of said first latch circuit, and a second constant-current driving circuit for supplying a driving current to the selected ones of said N electrode elements, in accordance with an output signal of said second latch circuit, simultaneously with the driving current supplied by said first constant-current driving circuit.

6. A printing apparatus according to claim 4, wherein said printing means is a printer of the type which utilizes an ink layer having a specific electricla resistance.

7. A printing apparatus comprising:

character-generating means storing items of character data, each constituted by a plurality of printing dot data;

first memory means for storing the items of character data read out from said character-generating means;

second memory means;

printing means; and control means for (a) deriving, from the character data stored in said first memory means, outline-image data representing horiozntal-outline portion of characters represented, respectively, by the character data, (b) writing the outline-image data into said second memory means, and (c) driving said printing means in accordance with the character data storing in said first memory means and also with the outline-image data stored in said second memory means, thereby printing, with a first printing energy, dots specified by both the character data and the outline-image data, and printing, with a second printing energy less than the first printing energy, dots specified only the character data;

wherein said printing means has N electrode elements, a first latch circuit for latching said character read out from said first memory means, a second latch circuit for latching said outline-image data read out from said second memory means, a first constant-current driving circuit for supplying a constant driving current to selected ones of said N electrode elements in accordance with an out signal of said first latch circuit, and a second constant-current driving circuit for supplying, simultaneously with the driving current supplied by said first constant-current driving circuit, a driving current to the selected ones of said N electrode elements in accordance with an output signal of said second latch circuit.

8. A printing device according to claim 7, wherein said printing means is a printer of the type which utilizes an ink layer having a specific electrical resistance.

9. A printing apparatus comprising: character-generating means storing items of character data, each constituted by a plurality of printing dot data;

first memory means for storing the items of character data read out from said character-generating means;

second memory means;

printing means; and control means for (a) deriving, from the character data stored in said first memory means, outline-image data representing the vertical-outline portions of characters represented, respectively, by the character data, (b) writing the outline-image data into said second memory means, and (c) driving said printing means in accordance with the character data stored in said first memory means and also with the outline-image data stored in said second memory means thereby printing, with a first printing energy, dots specified by both the character data and the outline-image data, and printing, with a second printing energy less than the first printing energy, dots specified only by the character data;

wherein said printing means has N electrode elements, a first latch circuit for latching said character data read out from said first memory means, a second latch circuit for latching said outline-image data read out from said second memory means, a first constant-current driving circuit for supplying a constant driving current to selected ones of said N electrode elements in accordance with an output signal of said first latch circuit, and a second constant-current driving circuit for supplying, simultaneously with the driving current supplied by said first constant-current driving circuit, a driving current to the selected ones of said N electrode elements in accordance with an output signal of said second latch circuit.

10. A printing device according to claim 9, wherein said printing means is a printer of the type which utilizes an ink layer having a specific electrical resistance.

* * * * *